US008666753B2

(12) United States Patent
Francois

(10) Patent No.: US 8,666,753 B2
(45) Date of Patent: Mar. 4, 2014

(54) APPARATUS AND METHOD FOR AUDIO ENCODING

(75) Inventor: Holly L. Francois, Guildford (GB)

(73) Assignee: Motorola Mobility LLC, Libertyville, IL (US)

( * ) Notice: Subject to any disclaimer, the term of this patent is extended or adjusted under 35 U.S.C. 154(b) by 162 days.

(21) Appl. No.: 13/316,895

(22) Filed: Dec. 12, 2011

(65) Prior Publication Data

US 2013/0151260 A1 Jun. 13, 2013

(51) Int. Cl.
*G10L 19/24* (2013.01)

(52) U.S. Cl.
USPC ..... 704/500

(58) Field of Classification Search
USPC ..... 704/500
See application file for complete search history.

(56) References Cited

U.S. PATENT DOCUMENTS

| | | | | |
|---|---|---|---|---|
| 5,115,240 | A | 5/1992 | Fujiwara et al. | |
| 5,742,734 | A | 4/1998 | Dejaco et al. | |
| 6,091,723 | A * | 7/2000 | Even | 370/386 |
| 2006/0004565 | A1 | 1/2006 | Eguchi | |
| 2009/0234645 | A1 | 9/2009 | Bruhn | |
| 2010/0324708 | A1 | 12/2010 | Ojanpera | |

OTHER PUBLICATIONS

3GPP LTE ETSI TS 126 290 v10.0.0 (Apr. 2011), Digital cellular telecommunications system (Phase 2+); Universal Mobile Telecommunications System (UMTS); LTE; Audio codec processing functions; Extended Adaptive Multi-Rate-Wideband (AMR-WB+) codec; Transcoding functions (3GPP TS 26.290 version 10.0.0. Release 10), all pages.

Patent Cooperation Treaty, International Search Report and Written Opinion of the International Searching Authority for International Application No. PCT/US2012/067532, Mar. 4, 2013, 10 pages.

* cited by examiner

*Primary Examiner* — Susan McFadden

(57) ABSTRACT

A method and apparatus provides for encoding an audio signal. A bit rate value is received. A set of energy thresholds based on the bit rate value is selected. The set of energy thresholds is one of a plurality of sets of energy thresholds. The energy thresholds of each set of energy thresholds correspond on a one-to-one basis with a set of sub-bands of the audio signal. The audio signal is received. The energy of each sub-band of the set of sub-bands is determined. A highest frequency sub-band that has an energy exceeding the corresponding threshold is determined. A selected bandwidth of the audio signal is encoded. The selected bandwidth includes only those frequencies of the audio signal that are in the highest frequency sub-band that has an energy exceeding the corresponding threshold, as well as the lower frequencies of the audio signal that are above a high-pass cut-off frequency.

18 Claims, 7 Drawing Sheets

100
HUMAN INTERFACE SYSTEM
TRANSMITTER SYSTEM
MICROPHONE
DISPLAY/ KEYBOARD
SPEAKER
A/D
HUMAN INTERFACE APPLICATIONS
D/A
RECEIVER SYSTEM
AUDIO CODING
PACKET GENERATOR
RF TRANSMITTER
102
104
106
108
120
125
126
130
135
140
141
170
181
182
187
190
199

705

LIMIT THE SELECTED BANDWIDTH TO ONE THAT DOES NOT RESULT IN A TRANSMITTED DATA RATE THAT EXCEEDS A MAXIMUM PERMITTED TRANSMITTED DATA RATE

FIG. 7

805

SELECT A SET OF HYSTERESIS VALUES THAT CORRESPOND TO THE SUB-BANDS OF THE AUDIO SIGNAL, BASED ON THE BIT RATE VALUE

FIG. 8

905

PERFORM STEPS 620, 625, 630 ON A PERIODIC BASIS

FIG. 9

APPARATUS AND METHOD FOR AUDIO ENCODING

FIELD OF THE INVENTION

The present invention relates generally to audio encoding and decoding.

BACKGROUND

In the last twenty years microprocessor speed increased by several orders of magnitude and Digital Signal Processors (DSPs) became ubiquitous. It became feasible and attractive to transition from analog communication to digital communication. Digital communication offers the major advantage of being able to more efficiently utilize bandwidth and allows for error correcting techniques to be used. Thus by using digital technology one can send more information through a given allocated spectrum space and send the information more reliably. Digital communication can use radio links (wireless) or physical network media (e.g., fiber optics, copper networks).

Digital communication can be used for different types of communication such as speech, audio, image, video or telemetry for example. A digital communication system includes a sending device and a receiving device. In a system capable of two-way communication each device has both sending and receiving circuits. In a digital sending or receiving device there are multiple staged processes through which the signal and resultant data is passed between the stage at which the signal is received at an input (e.g., microphone, camera, sensor) and the stage at which a digitized version of the signal is used to modulate a carrier wave and transmitted. After (1) the signal is received at the input and then digitized, (2) some initial noise filtering may be applied, followed by (3) source encoding and (4) finally channel encoding. At a receive device, the process works in reverse order; channel decoding, source recovery, and then conversion to analog. The present invention as will be described in the succeeding pages can be considered to fall primarily in the source encoding stage.

The main goal of source encoding is to reduce the bit rate while maintaining perceived quality to the extent possible. Different standards have been developed for different types of media.

BRIEF DESCRIPTION OF THE DRAWINGS

The features of the invention believed to be novel are set forth with particularity in the appended claims. The invention itself however, both as to organization and method of operation, together with objects and advantages thereof, may be best understood by reference to the following detailed description, which describes certain exemplary embodiments of concepts that include the invention. The description is meant to be taken in conjunction with the accompanying drawings in which:

FIGS. 6-9 are flow charts showing operation of the audio encoding function, in accordance with various embodiments.

Figure 1:
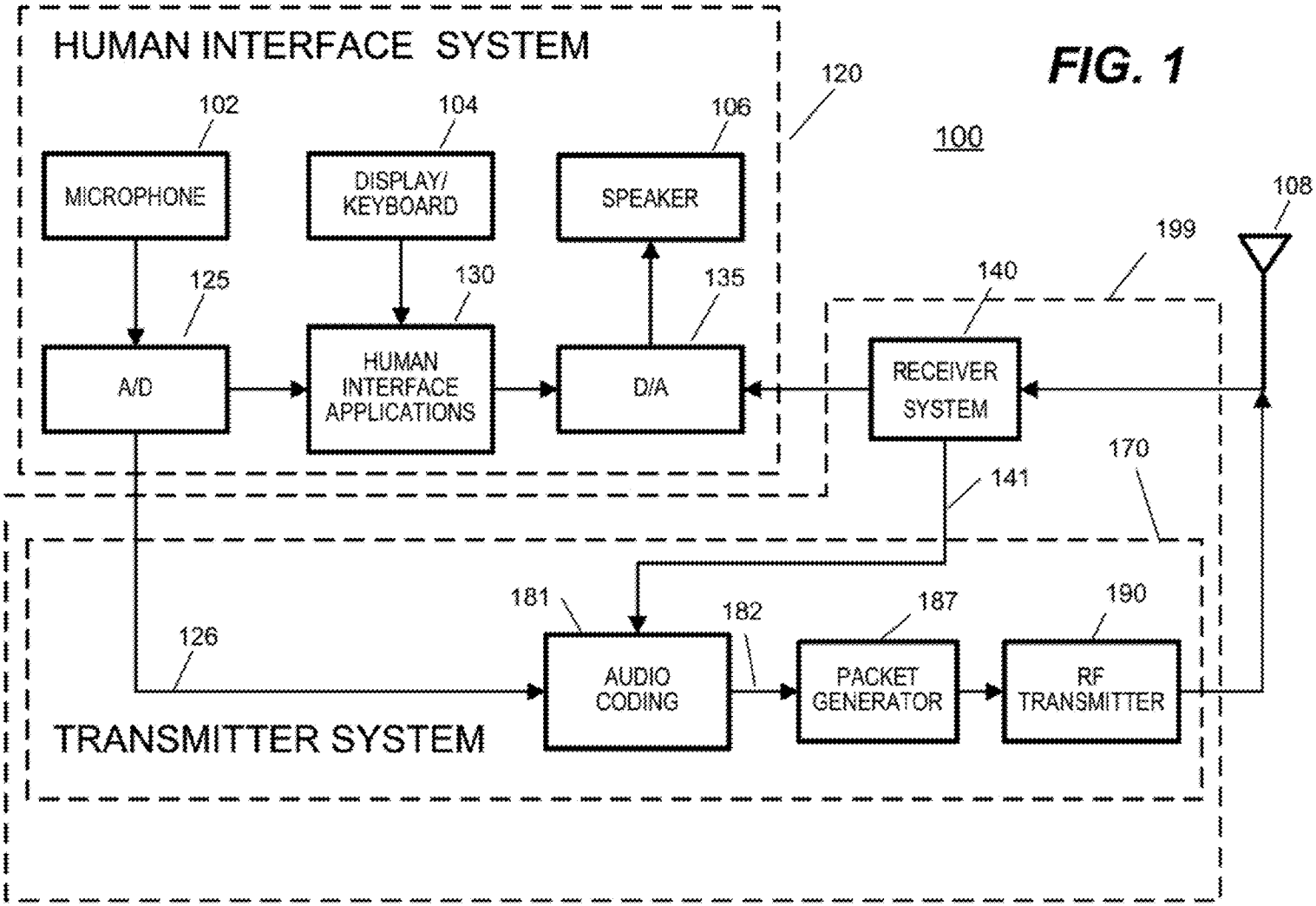
FIG. 1 is a block diagram of a communication device, in accordance with certain embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described. In the description below, like reference numerals are used to describe the same, similar or corresponding parts in the several views of the drawings.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

Reference throughout this document to "one embodiment", "certain embodiments", "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Embodiments described herein relate to encoding signals. The signals can be speech or other audio such as music that are converted to digital information and communicated by wire or wirelessly.

Turning now to the drawings, wherein like numerals designate like components, FIG. 1 is a block diagram of a wireless electronic communication device 100, in accordance with certain embodiments. The wireless electronic communication device 100 is representative of many types of wireless communication devices, such as mobile cell phones, mobile personal communication devices, cellular base stations, and personal computers equipped with wireless communication functions. In accordance with some embodiments, wireless electronic communication device 100 comprises a radio system 199, a human interface system 120, and a radio frequency (RF) antenna 108.

The human interface system 120 is a system that comprises a processing system and electronic components that support the processing system, such peripheral I/O circuits and power control circuits, as well as electronic components that interface to users, such as a microphone 102, a display/touch keyboard 104, and a speaker 106. The processing system comprises a central processing unit (CPU) and memory. The CPU processes software instructions stored in the memory that primarily relate to human interface aspects of the mobile communication device 100, such as presenting information on the display/keyboard 104 (lists, menus, graphics, etc.) and detecting human entries on a touch surface of the display/keyboard 104. These functions are shown as a set of human interface applications (HIA) 130. The HIA 130 may also receive speech audio from the microphone 102 through the analog/digital (ND) converter 125, then perform speech recognition of the speech and respond to commands made by speech. The HIA 130 may also send tones such as ring tones to the speaker 106 through digital to analog converter (D/A) 135 The human interface system 120 may comprise other human interface devices not shown in FIG. 1, such as haptic devices and a camera.

The radio system 199 is a system that comprises a processing system and electronic components that support the processing system, such peripheral I/O circuits and power control circuits, as well as electronic components that interface to the antenna, such as RF amplifiers. The processing system comprises a central processing unit (CPU) and memory. The CPU processes software instructions stored in the memory that primarily relate to radio interface aspects of the mobile communication device 100, such as transmitting digitized signals that have been encoded to data packets (shown as transmitter system 170) and receiving data packets that are decoded to digitized signals (shown as receiver system 140). But for the antenna 108 and certain radio frequency interface portions of receiver system 140 and transmitter system 170 (not explicitly shown in FIG. 1), the wireless electronic communication device 100 would also represent many wired communication devices such as cable nodes. Some embodiments that follow are a personal communication device.

The receiver system 140 is coupled to the antenna 108. The antenna 108 intercepts radio frequency (RF) signals that may include a channel having a digitally encoded signal. The intercepted signal is coupled to the receiver system 140, which decodes the signal and couples a recovered digital signal in these embodiments to a human interface system 120, which converts it to an analog signal to drive a speaker. In other embodiments, the recovered digital signal may be used to present an image or video on a display of the human interface system 120. The transmitter system 170 accepts a digitized signal 126 from the human interface system 120, which may be for example, a digitized speech signal, digitized music signal, digitized image signal, or digitized video signal, which may be coupled from the receiver system 140, stored in the wireless electronic communication device 100, or sourced from an electronic device (not shown) coupled to the electronic communication device 100. The digitized signal is one that has been sampled at a periodic digitizing sampling rate. The digitized sampling rate may be, for example 8 KHz, 16 KHz, 32 KHz, 48K Hz, or other sampling rates that are not necessarily multiples of 8 KHz. It will be appreciated that the bandwidth of the signal being sampled may be less than ½ the sampling rate. For example, in some embodiments a signal having a bandwidth of 12 KHz may have been sampled at a 48 KHz sampling rate. The transmitter system 170 analyzes and encodes the digitized signal 126 into digital packets that are transmitted on an RF channel by antenna 108.

The transmitter system 170 comprises an audio coding function 181 that periodically analyzes the samples of the digitized signal and encodes them into bandwidth efficient code words 182. The code words 182 are generated at a bit rate determined by a frequency analysis of the digitized signal 126 and a bit rate value 141 that is received in a message from a network device and coupled from the receiver system 140 to the audio coding function 181. A bit rate value 141 received from a network may in some embodiments define a permitted bit rate that the device 100 may not exceed for transmissions to the network, which would typically be determined by a network operator or network device based on the current network traffic loading. The bit rate value in some embodiments may define a permitted bit rate that must be met as an average value but having instantaneous values within some tolerance (e.g., not more than 10% above the average value) by the device 100. An example of this type of bit rate value may be one that restricts the transmission bit rate used by the device 100 in accordance with a fee structure. In some embodiments, the bit rate value 141 may be coupled from the human interface system 120 instead of the receiver system 140. A packet generator 187 uses the code words 182 to form packets that are coupled to an RF transmitter 190 for amplification, and are then radiated by antenna 108.

Figure 2:
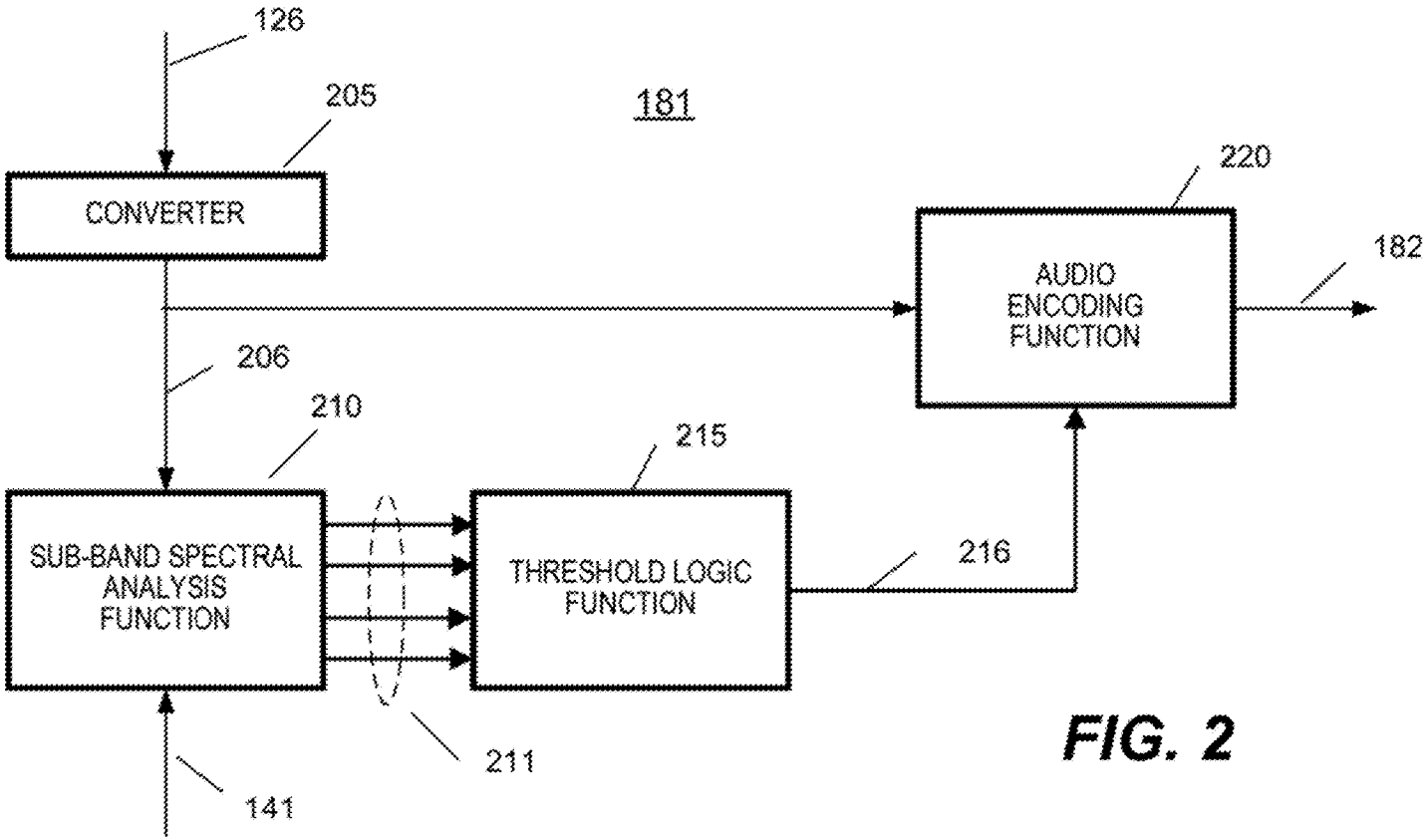
FIG. 2 is a block diagram of an audio encoding function of the communication device, in accordance with certain embodiments.

Referring to FIG. 2, a block diagram of the audio coding function 181 is shown, in accordance with certain embodiments. The audio coding function 181 comprises a converter 205, a sub-band spectral analysis function 210, a threshold logic function 215, and an audio encoding function 220. The converter 205 may not be used in some embodiments. The converter 205 converts the digitized signal 126 to a converted signal 206 that provides values at a periodic rate that is constant irrespective of the sampling rate of the digitized signal 126. For example, digitized signals 126 having differing sampling rates such as 8 KHz, 12 KHz, and 16 KHz may be all be converted to the converted signal 206 at a periodic rate of 48 KHz. The conversion may be performed by standard techniques such as using one of many interpolation techniques. In some embodiments, the sampling rate of digitized signal 126 may not change, thereby making the converter 205 unnecessary. In these embodiments, digitized signal 126 may be coupled directly to the sub-band spectral analysis function 210 and the audio encoding function 220. In some embodiments, the digitized signal 126 may be coupled directly to the sub-band spectral analysis function 210 and the audio encoding function 220 and the conversion function may be performed in one or both of the sub-band spectral analysis function 210 and the audio encoding function 220. The sub-band spectral analysis function 210 analyzes the energies in each of an ordered set of sub-bands and couples the sub-band energy results 211 to the threshold logic function 215, which determines one of a plurality of protocols, each having a particular bandwidth at which the code words 182 are encoded, based on the sub-band energy results 211 and the bit rate value 141. The determined protocol 216 (also identified as the selected bandwidth or selected protocol) is coupled to the audio encoding function 220 and varies over time depending on the sub-band energy results 211 and the bit rate value 141, which is coupled to the sub-band spectral analysis function 210. The audio encoding function 220 uses the selected bandwidth 216 to perform the encoding of the digitized 126 audio signal and generate the code words 182, thereby minimizing encoding resources and reducing the average bandwidth required to convey the audio signal. It will be appreciated that the low frequency cut-off values (the high pass frequency) of the plurality of protocols are sufficiently close in value that the order of upper cutoff frequencies is that same as the order of the bandwidths of the protocols; i.e. a higher bandwidth correlates to a higher upper cutoff frequency.

Figure 3:
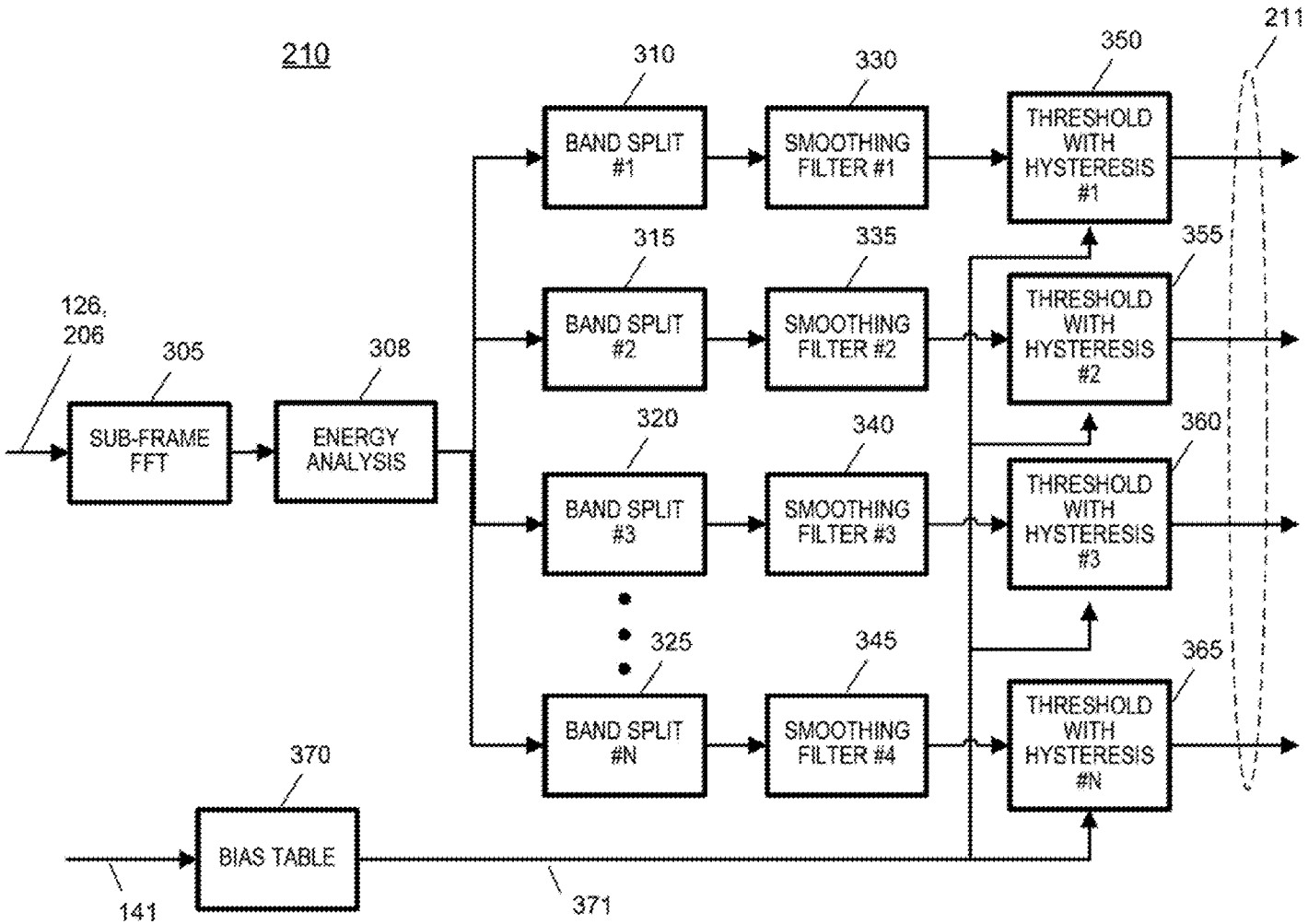
FIG. 3 is a block diagram of a sub-band spectral analysis function of the audio encoding function, in accordance with certain embodiments.
Figure 4:
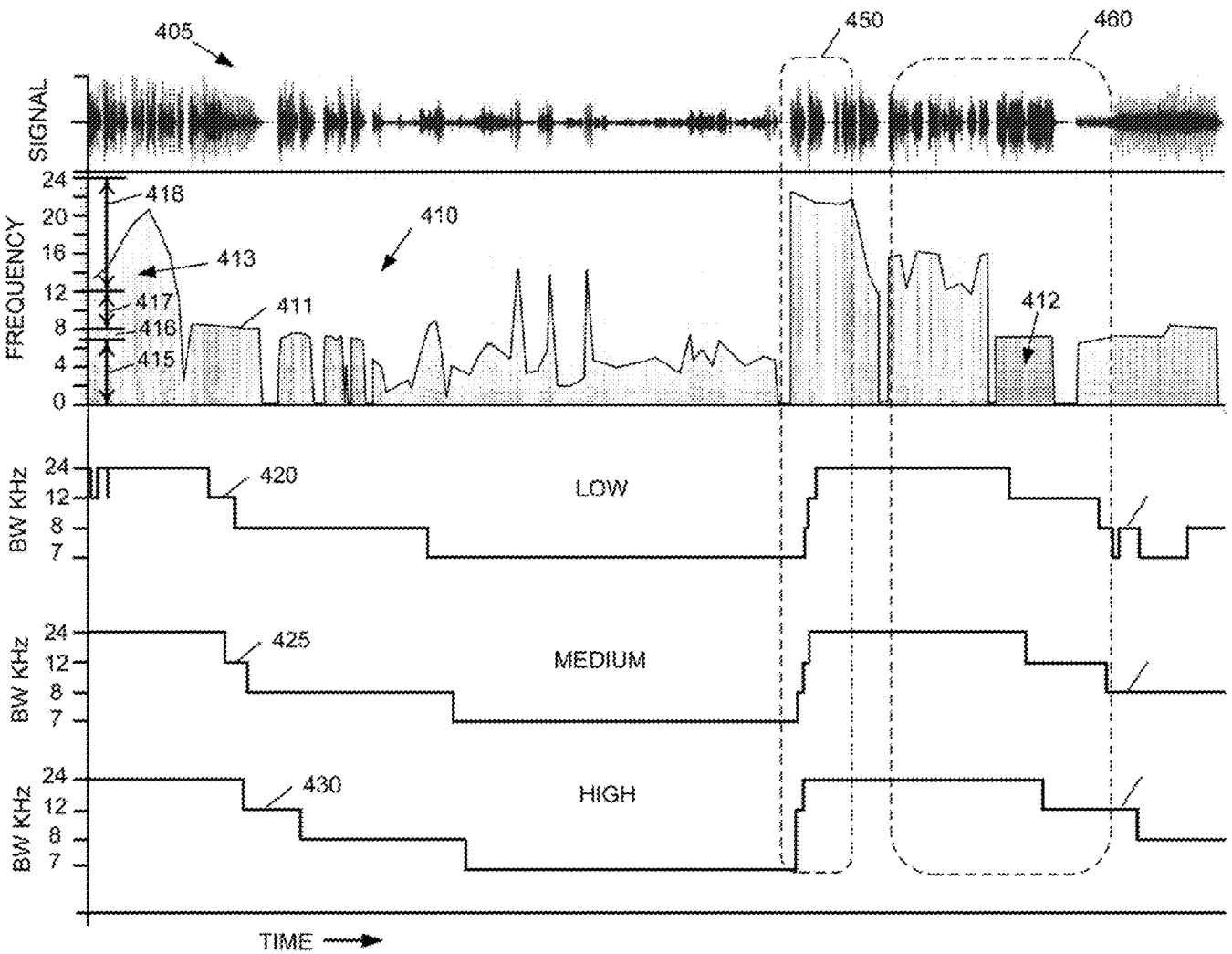
FIG. 4 shows timing diagrams of some exemplary signals in the communication device, in accordance with certain embodiments.
Figure 5:
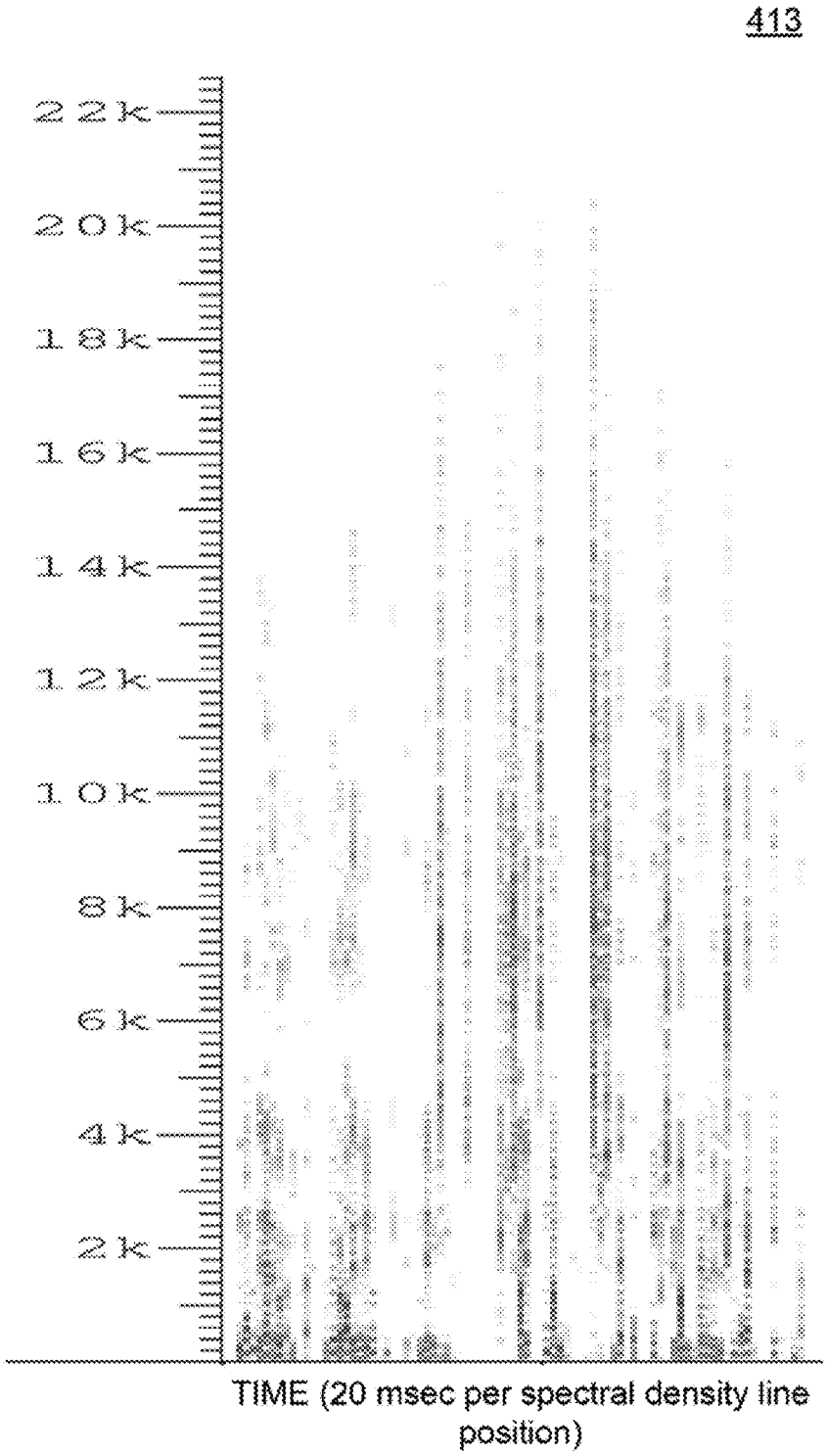
FIG. 5 shows an expanded portion of a timing diagram from FIG. 4, in accordance with certain embodiments.

Referring to FIGS. 3-5, a block diagram of the sub-band spectral analysis function 210 is shown in FIG. 3 and timing diagrams of some exemplary signals are shown in FIGS. 4 and 5, in accordance with certain embodiments. The sub-band spectral analysis function 210 comprises a sub-frame Fast Fourier Transform (FFT) function 305, an energy analysis function 308, a set of N band split functions 310-325, a set of N corresponding smoothing filters 330-345, and a set of N corresponding threshold-with-hysteresis-functions 350-365. The digitized signal 126 or converted signal 206 is coupled to the sub-frame FFT function 305, which performs a Fast Fourier Transform at some multiple of the frame rate, for example 4, that corresponds to the rate of the digitized signal 126 or converted signal 206. For example, 160 values of the digitized signal 126 or converted signal 206 may be included in each frame or sub-frame. Conventional techniques (e.g., tapered overlaps, etc.) may be used for frame or sub-frame windowing and for performing the FFT. The set of values generated by the FFT of each frame or sub-frame is coupled to the energy analysis function 308, which converts each set of FFT values to a corresponding set of energy spectral distribution values in a conventional manner (e.g., using the squares of the absolute values of the FFT values). The energy spectral distributions for a series of frames or sub-frames, like the sets of FFT values, are frequency based distributions that are generated at a periodic frame or sub-frame rate. In one example, the value, N, used to identify the quantity of band splits 310-325, smoothing filters 330-345, and thresholds 350-365 is four. An example of a digitized audio signal 126 or converted signal 206 is shown as audio plot 405 in FIG. 4. Here, the audio plot 405 appears to be continuous because the digitized values (e.g., digitized voltage samples) are relatively close together in the plot. Below audio plot 405 is a plot 410 that represents an audio spectrogram. Each vertical line comprises many grey scale values (pixels or spots) that represent the energy density of one frame for frequencies between 0 and 24 KHz. The peak frequencies with non-zero energy values are approximated by plot 411. The maximum energy density of each frame for about half the regions of plot 410 is well below the peak value. One example of this is region 413 of plot 410, which is shown in an expanded view in FIG. 5. Other regions have more uniformly distributed energy, such as region 412 of plot 410.

The energy analysis is coupled to the band split functions 310-325, which determine the total amount of energy in each sub-band. The sub-band ranges for an example that will be used herein are 0-7 KHz for band split #1 310, 7-8 KHz for band split #2 315, 8-16 KHz for band split #3 320, and 16-20 KHz for band split #4 (not shown in FIG. 3). The exemplary frequency ranges of the band splits #1 to #4 are identified as frequency sub-bands 415-418 on FIG. 4. It will be appreciated that for the embodiments represented by this example, this set of sub-bands is a set of sub-bands that cover the full frequency range of 0 to 24 KHz without overlap. In other embodiments the set of sub-bands may not fill the full bandwidth of 0 to 24 KHz; there may be gaps between sub-bands. In some embodiments, the sub-bands may overlap. The outputs of the band split functions 310-325 are coupled to the smoothing filters 330-345, which remove high frequency effects that would cause changes at the outputs of the threshold-with-hysteresis-functions 350-365 that would be too rapid. The outputs of the smoothing filters 330-345 are coupled to the threshold-with-hysteresis-functions 350-365. Each of threshold-with-hysteresis-functions 350-365 is also coupled to a threshold signal 371 from bias table 370. The threshold signal includes bias and hysteresis values for each of the threshold-with-hysteresis-functions 350-365 that are determined by the bit rate value 141. The bit rate value 141 is a value that is one of M values, each of which is used to set levels in the N threshold-with-hysteresis-functions 350-365 which are used as one factor to select one of N protocols that are used to encode the signal 126, 206. In certain embodiments each protocol encodes a different bandwidth of the signal 126, 206. In an example used herein, M is three and the three values are identified as low, medium, and high values. The bit rate value 141 selects one of M threshold values for each of the threshold-with-hysteresis-functions 350-365. Thus, each of the possible M bit rate values selects a set of N thresholds that correspond to the sub-bands. Each threshold-with-hysteresis-function 350-365 generates an output value that is part of signal 211. The output value is in a first state (TRUE) when the input exceeds the threshold for a duration exceeding a first hysteresis value, and is in a second state (FALSE) when the input is less than the threshold for a duration exceeding a second hysteresis value. The hysteresis values may be the same for all of the sub-bands, and may be fixed. In some embodiments the first and second hysteresis values for the threshold-with-hysteresis-functions 350-365 may be 2N different values, and in some embodiments, the first and second N hysteresis values may be selected from a set of M values by the bit rate value 141. In accordance with the example being described herein, the first hysteresis values are zero and the second hysteresis values are not different among the threshold-with-hysteresis-functions 350-365 and do not change in response to the bit rate value 141. (However, the threshold values do change in response to the bit rate value 141.)

Referring back to FIG. 2, the output signal 211 from the sub-band spectral analysis function 210 is coupled to the threshold logic function 215. The threshold logic function 215 analyzes the signals 211 and selects an encoding protocol based on the values of the output signals 211 indicating the highest frequency of the N sub-bands that is in the first state. Sub-bands below this frequency are also assumed to be in this first state for the purposes of signal detection. The selected encoding protocol encodes a bandwidth of the signal 126, 206 that includes those frequencies of the audio signal (digitized signal 126 or converted signal 206) up to the highest frequency sub-band that has an energy exceeding the corresponding threshold, as well as lower frequency components of the audio signal which are above a high-pass cut off frequency of the selected encoding protocol to the audio encoding function 220. In some embodiments, all lower frequency components of the audio signal which are above a high-pass cut off frequency are included in the bandwidth of the selected encoding protocol. In some embodiments it may be necessary or desirable to apply high pass or band pass filtering to the input signal 126 prior to sub-band spectral analysis 210 and/or audio encoding 220 but this would not significantly affect the processing steps or the processing logic. In the example being described herein, the selected encoding protocol is one that has a selected bandwidth that is nominally one of 7 KHz bandwidth, 8 KHz bandwidth, 12 KHz bandwidth, and 20 KHz bandwidth but this may correspond in practice to bands starting between 10 Hz to 500 Hz and extending up to 7 KHz, starting between 10 Hz to 500 Hz and extending up to 8 KHz, starting between 10 Hz to 500 Hz and extending up to 12 KHz bandwidth or starting between 10 Hz to 500 Hz and extending up to 20 KHz respectively. Other manners of identifying the selected encoding protocol could obviously be used, of which just two examples are an encoding bit rate, or an indexed protocol value (e.g., 1 to 4).

Referring to Table 1, a set of threshold values is shown, in accordance with certain embodiments. The set is one that could be used for the example that has been described herein above, and may be included in the bias table 370 (FIG. 3). For this example, a maximum value for a threshold is 100 and the total energy of the signal 126, 206 has a value of 100.

TABLE 1

| | Sub-Bands | | | |
|---|---|---|---|---|
| Bit Rate Value | up to 7 KHz | 7-8 kHz | 8-12 kHz | 12-20 kHz |
| Low | 30 | 6 | 50 | 60 |
| Medium | 25 | 5 | 45 | 50 |
| High | 20 | 4 | 25 | 30 |

It will be appreciated that when the energy density is uniform the total energy in each sub-band would be, from the lowest sub-band to the highest sub-band 35, 5, 20, and 40 respectively. When the bit rate value 141 is Low and the energy density is uniform, the respective outputs of the threshold-with-hysteresis-functions 350-365, from lowest to highest, would be TRUE, FALSE, FALSE, and FALSE because the only threshold that is exceeded is the one for 0-7 KHz. Since the highest sub-band for which the threshold is TRUE is the 0-7 KHz sub-band, the selected bandwidth is 7 KHz. When the energy density is uniform and the bit rate value 141 is High, the respective outputs of the threshold-with-hysteresis-functions 350-365, from lowest to highest, would be TRUE, TRUE, FALSE, and TRUE. Since the highest sub-band for which the threshold is TRUE is the 12-20 KHz sub-band, the threshold logic function 215 selects the protocol that provides a 20 KHz bandwidth. Below plots 405, 410 in FIG. 4 are shown three plots 420, 425, 430. These plots show the output 216 versus time of the threshold logic function 215 for the three values (low, medium, high) of the bit rate value 141 when the input signal 126, 206 is the signal shown as plot 405 of FIG. 5, for a set of threshold values similar to Table 1. Plot 420 is generated when the bit rate value is Low, plot 425 is generated when the bit rate value is Medium, and plot 430 is generated when the bit rate value is High. It can be seen that plot 420 has the lowest bandwidth value (7 KHz) for a higher percentage of time than plots 425, 430, and plot 430 has the highest bandwidth value for a higher percentage of time than plots 420, 425. This difference can be easily magnified or reduced by appropriately modifying the values of the thresholds. The effect of the second hysteresis value is evident in region 460 of the plots, which shows a slow change from highest bandwidth to lower bandwidths, while the zero value of the first hysteresis leads to a fast change from lowest to highest bandwidth, which is evident in region 450 of the plots. The benefit of the filtering performed the smoothing filters 330-345 is evident by the fact that the incidence of outputs 216 (in the example graphed by plots 420-430) having durations between value changes of less than approximately 10 frames (energy density lines) is very small.

In certain embodiments, if there is a maximum permitted transmit data rate that would be exceeded by using any of the selectable bandwidths, then the transmitter system 170 may include logic to prevent protocols having such bandwidths from being used, by limiting the selection of bandwidths to lower bandwidth protocols that always keeps the transmitted data rate below the maximum permitted transmitted data rate. This additional restriction may be incorporated in the threshold logic function 215 based on an indication received in a protocol message received by receiver system 140. The indication could be used, for example, to select one of several different tables of values, some of which have thresholds chosen to preclude the use of high bandwidths, or may be logic that alters the selected bandwidth to a lower one if it would result in an excessive transmitted data rate.

It will be appreciated that by having the flexibility of defining sets of threshold values (and in some embodiments corresponding hysteresis values) that are selected by choosing a bit rate value, the average transmitted bit rate can be lowered in accordance with channel conditions while the audio quality is more optimally maintained than that when bit rate restrictions are imposed in systems that use conventional techniques. In some embodiments it will be appreciated that it is desirable to match the audio bandwidth of the encoding protocol to that of the input signal as closely as possible while the bandwidth of the input signal varies over time. In other words the threshold values are empirically determined so that the audio bandwidths of the encoding protocols that are sequentially selected during an input signal track the varying bandwidth of the input signal. The input signal used is one or more audio sequences typical of those that are expected to be encoded. Such a configuration would be appropriate to achieve medium channel bit rates (a so called Med bit rate setting). In some embodiments, when for example the channel bit rate available to the encoding protocol is limited and better sounding synthetic audio is produced when the input signal bandwidth is reduced, the sub-band spectral analysis function 210 may be biased such that lower audio bandwidth encoding protocols are favoured; a so called Low bit rate setting. When a higher channel bit rate is available to the encoding protocol in some embodiment, the sub-band spectral analysis function 210 may be biased such that higher audio bandwidth encoding protocols are favoured; a so called High bit rate setting. In some embodiments, a change in the bit rate value during the audio signal alters the selection of the set of thresholds from the available sets as soon as practical within the constraints of the encodings protocols that are used, which provides a quicker change of the average channel bit rate. This allows better control of the combined bandwidth of several devices that are using a shared bandwidth.

Lower audio bandwidth encoding protocols being "favoured" means that the thresholds are empirically set so that the default output will be encoded using a low audio bandwidth encoding protocol, only switching to a higher bandwidth encoding protocol, that has a channel bit rate that is similar to (e.g., within 10% in some embodiments; in other embodiments the similarity tolerance may be as high as 50%) of the channel bit rate of the low audio bandwidth encoding protocol, for limited time periods. This switching will occur when the energy in a higher sub-band is large enough that the perceptual advantage of encoding the higher audio bandwidth outweighs the degradation caused by reducing the number of encoding bits allocated to the audio signal within the lower audio bandwidths. The low audio bandwidth encoding protocol encodes a bandwidth that includes the lowest audio sub-band and may include higher sub-band(s) up to and including a particular higher audio sub-band (but not the highest sub-band). The low audio bandwidth is determined based on input signals of the type expected to be encoded, and may be determined based on theoretical methods (e.g., accuracy), empirical methods (e.g., expert listening or Mean Opinion Score (MOS) tests), or may be the lowest encoding protocol bandwidth usable in a system at a particular time.

Higher audio bandwidths being "favoured" means that the thresholds are empirically set so that the output will be encoded using a high audio bandwidth encoding protocol, only switching to a lower bandwidth encoding protocol for time periods where the high frequency energy, e.g., the energy corresponding to the top sub-band in the input signal, is imperceptible to the average listener. The high audio bandwidth encoding protocol encodes a bandwidth that includes the highest audio sub-band and may include lower sub-band(s) down to and including a particular lower audio sub-band. The high audio bandwidth is determined based on input signals of the type expected to be encoded, and may be determined based on theoretical methods (e.g., accuracy), empirical methods (e.g., expert listening or Mean Opinion Score (MOS) tests)), or may be the highest encoding protocol bandwidth usable in a system at particular time. The empirically determined threshold settings for the above described Med, Low, and High bit rates could be used in a single embodiment in the form of a correspondence table such as the one shown in Table 1 (but having the empirically determined values). The first and second Hysteresis values could also be empirically determined for the Med, Low and High bit rates in the single embodiment. The first and second hysteresis values may be the same for the transitions in each of the Med, Low and High bit rates.

Figure 6:
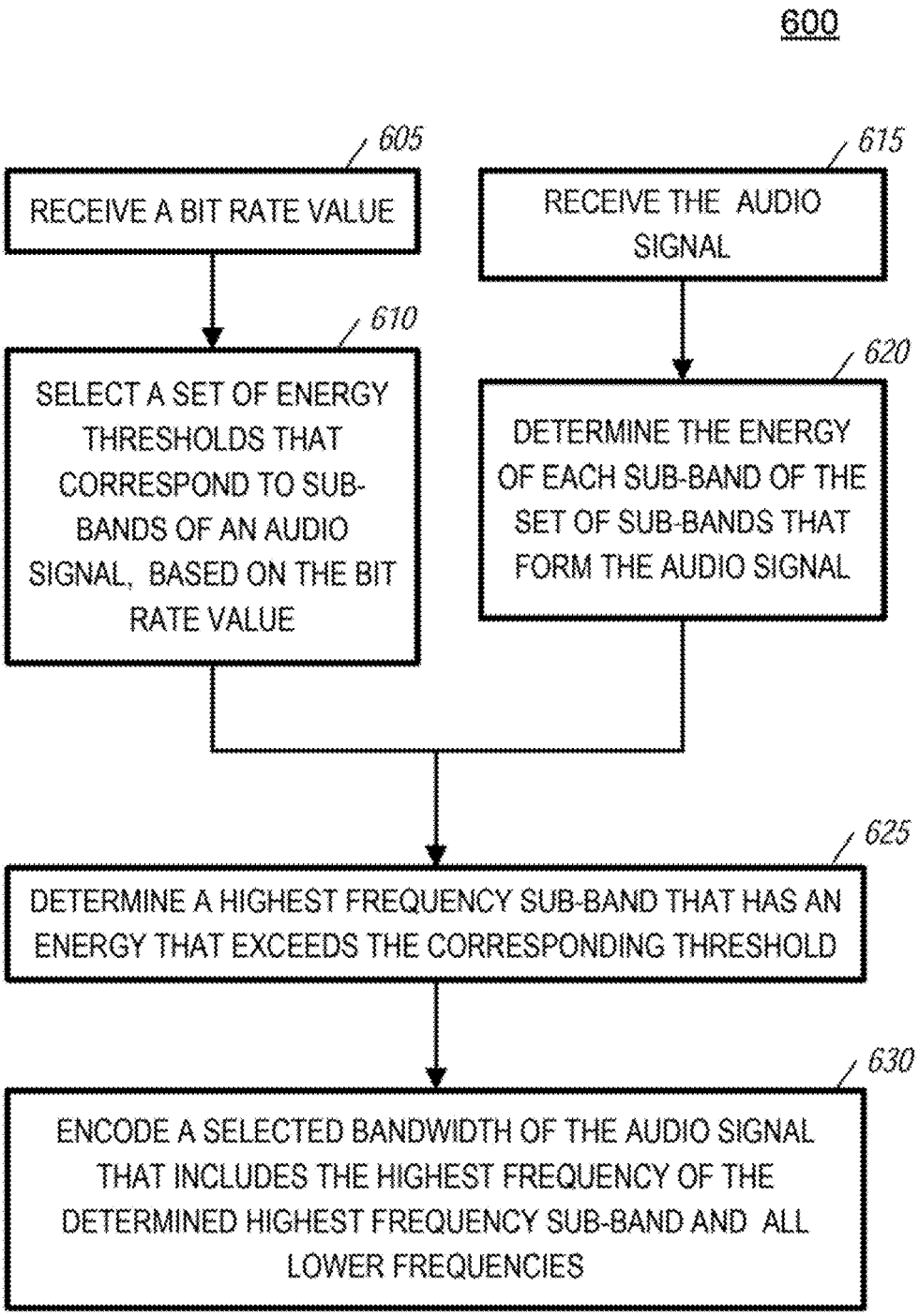

Referring to FIG. 6, some steps of a method 600 of encoding an audio signal are shown, in accordance with certain embodiments. The encoding may be performed in a personal communication device such as a cellular telephone or a netpad, or a telemetry device, or a fixed network device. The steps do not necessarily need to be performed in the order shown. At step 605 a bit rate value is received. The bit rate value is one of a set of M bit rate values. The bit rate values may have identities. Non-limiting examples of such identities are: low, medium, and high when M is three, or index values (first, second, etc.). A set of energy thresholds is selected at step 610, based on the bit rate value. The set of energy thresholds is one of a plurality, N, of sets of energy thresholds. The energy thresholds of each set of energy thresholds correspond on a one-to-one basis with a set of sub-bands of the audio signal. (Thus there are also N sub-bands of the audio signal). At step 615, the audio signal is received. The energy of each sub-band of the set of N sub-bands is determined at step 620. At step 625, a highest frequency sub-band that has an energy exceeding the corresponding threshold is determined. A selected bandwidth of the audio signal is encoded at step 630. The selected bandwidth includes only those frequencies of the audio signal that are in the highest frequency sub-band that has an energy exceeding the Corresponding threshold, as well as substantially all lower frequencies of the audio signal. It will be appreciated that steps 605-610 can be performed before, after, or approximately simultaneously with reference to steps 615-620. The relationship between the steps described herein and the functional blocks described with reference to FIG. 2 is that steps 615 and 620 may be performed by the sub-band spectral analysis function 210; steps 605, 610, and 625 may be performed by the threshold logic function 215, and step 630 may be performed by the audio encoding function 220.

Referring to FIGS. 7-9, some steps of the method 600 of encoding an audio signal are shown, in accordance with certain embodiments. At step 705 (FIG. 7), the selected bandwidth is limited to one that does not result in a transmitted data rate that exceeds a maximum permitted transmitted data rate. At step 805 (FIG. 8), a set of hysteresis values is selected based on the bit rate value. The values correspond to the sub-bands of the audio signal. The hysteresis values include at least one of a hysteresis delay for changing from a lower selected bandwidth to a higher selected bandwidth and a hysteresis delay for changing from a higher selected bandwidth to a lower selected bandwidth. At step 905 (FIG. 9), an event or events is/are responded to that is/are used to perform at least the steps of determining the energy 620, determining the highest frequency sub-band 625, and encoding 630, on respective periodic bases. The events may be interrupts or counts of other events. In some embodiments, they may be performed using a common period. In certain embodiments, the periodic bases may not all be the same. For example, the step of determining the energy 620 may be performed at a higher rate than the step of determining the highest frequency sub-band 625. This would have an effect of adding delay for some bandwidth decisions. Additionally, receiving the audio signal at step 615 is typically performed on a periodic basis (e.g., a digitized audio sampling rate) that is much greater than the periodic basis (e.g., an audio frame rate) used for determining the energy of each sub-band that is performed by the sub-band spectral analysis function 210.

The processes illustrated in this document, for example (but not limited to) the method steps described in FIGS. 6-9, may be performed using programmed instructions contained on a computer readable medium which may be read by processor of a CPU. A computer readable medium may be any tangible medium capable of storing instructions to be performed by a microprocessor. The medium may be one of or include one or more of a CD disc, DVD disc, magnetic or optical disc, tape, and silicon based removable or non-removable memory. The programming instructions may also be carried in the form of packetized or non-packetized wireline or wireless transmission signals.

In the foregoing specification, specific embodiments of the present invention have been described. However, one of ordinary skill in the art appreciates that various modifications and changes can be made without departing from the scope of the present invention as set forth in the claims below. As examples, in some embodiments some method steps may be performed in different order than that described, and the functions described within functional blocks may be arranged differently (e.g., the bias table 370 and threshold with hysteresis blocks 350-365 could be a part of the threshold logic function 215 instead of the sub-band spectral analysis function 210). As another example, any specific organizational and access techniques known to those of ordinary skill in the art may be used for tables such as the bias table 370. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed is:

1. A method for encoding an audio signal at a communication device, comprising:

receiving, at the communication device, a bit rate value;

selecting, by a processing system of the communication device, a set of energy thresholds based on the bit rate value, wherein the set of energy thresholds is one of a plurality of sets of energy thresholds, and wherein the energy thresholds of each set of energy thresholds correspond on a one-to-one basis with a set of sub-bands of the audio signal;

receiving, at the communication device, the audio signal;

determining, by the processing system, the energy of each sub-band of the set of sub-bands;

determining, by the processing system, a highest frequency sub-band that has an energy exceeding the corresponding threshold;

determining, by the processing system, a selected bandwidth of the audio signal that includes only those frequencies of the audio signal that are in the highest frequency sub-band that has an energy exceeding the corresponding threshold, as well as all lower frequencies of the audio signal that are above a high-pass cut-off frequency; and encoding, by an audio coding function of the communication device, the selected bandwidth.

2. The method according to claim 1, further comprising limiting, by the processing system, the selected bandwidth to one that does not result in a transmitted data rate that exceeds a maximum permitted transmitted data rate.

3. The method according to claim 1, further comprising selecting, by the processing system, a set of hysteresis values based on the bit rate value that correspond to the set of sub-bands of the audio signal, wherein the hysteresis values include at least one of a hysteresis delay for changing from a lower selected bandwidth to a higher selected bandwidth and a hysteresis delay for changing from a higher selected bandwidth to a lower selected bandwidth.

4. The method according to claim 1, further comprising performing, by the processing system, the steps of determining the energy, determining the highest frequency sub-band, and encoding on respective periodic bases during the encoding of the audio signal.

5. The method according to claim 1, wherein the thresholds of two or more sets of energy thresholds are such that two or more of the following conditions exist: lower audio bandwidth encoding protocols are favored, audio bandwidths of the encoding protocols that are selected track the varying bandwidth of the input signal, and higher audio bandwidth encoding protocols are favored.

6. The method according to claim 1, wherein a change in the bit rate value during the audio signal alters the selection of the set of thresholds from the plurality of sets.

7. An apparatus for encoding an audio signal, comprising:

a receiver of a communication device for receiving a bit rate value; and a processing system of the communication device for selecting a set of energy thresholds based on the bit rate value, wherein the set of energy thresholds is one of a plurality of sets of energy thresholds, and wherein the energy thresholds of each set of energy thresholds correspond on a one-to-one basis with a set of sub-bands of the audio signal;

receiving the audio signal, determining the energy of each sub-band of the set of sub-bands, determining a highest frequency sub-band that has an energy exceeding the corresponding threshold, and determining a selected bandwidth of the audio signal that includes only those frequencies of the audio signal that are in the highest frequency sub-band that has an energy exceeding the corresponding threshold, as well as all lower frequencies of the audio signal that are above a high-pass cut-off frequency; and encoding the selected bandwidth.

8. The apparatus according to claim 7, wherein the processing system of the communication device further comprising limiting the selected bandwidth to one that does not result in a transmitted data rate that exceeds a maximum permitted transmitted data rate.

9. The apparatus according to claim 7, wherein the processing system of the communication device further comprising selecting a set of hysteresis values based on the bit rate value that correspond to the set of sub-bands of the audio signal, wherein the hysteresis values include at least one of a hysteresis delay for changing from a lower selected bandwidth to a higher selected bandwidth and a hysteresis delay for changing from a higher selected bandwidth to a lower selected bandwidth.

10. The apparatus according to claim 7, wherein the processing system of the communication device further comprising performing the steps of determining the energy, determining the highest frequency sub-band, and encoding on respective periodic bases during the encoding of the audio signal.

11. The apparatus according to claim 7, wherein the thresholds of two or more sets of energy thresholds are such that two or more of the following conditions exist: lower audio bandwidth encoding protocols are favoured, audio bandwidths of the encoding protocols that are selected track the varying bandwidth of the input signal, and higher audio bandwidth encoding protocols are favoured.

12. The apparatus according to claim 7, wherein a change in the bit rate value during the audio signal alters the selection of the set of thresholds from the plurality of sets.

13. A non-transitory tangible media that stores programming instructions that, when executed on a processor of a communication device having hardware associated therewith for receiving an audio signal, performs encoding of an audio signal, comprising:

receiving a bit rate value;

selecting a set of energy thresholds based on the bit rate value, wherein the set of energy thresholds is one of a plurality of sets of energy thresholds, and wherein the energy thresholds of each set of energy thresholds correspond on a one-to-one basis with a set of sub-bands of the audio signal;

receiving the audio signal;

determining the energy of each sub-band of the set of sub-bands;

determining a highest frequency sub-band that has an energy exceeding the corresponding threshold;

determining a selected bandwidth of the audio signal that includes only those frequencies of the audio signal that are in the highest frequency sub-band that has an energy exceeding the corresponding threshold, as well as all lower frequencies of the audio signal that are above a high-pass cut-off frequency; and encoding the selected bandwidth.

14. The tangible media according to claim 13, wherein the instructions further perform: limiting the selected bandwidth to one that does not result in a transmitted data rate that exceeds a maximum permitted transmitted data rate.

15. The tangible media according to claim 13, wherein the instructions further perform: selecting a set of hysteresis values based on the bit rate value that correspond to the set of sub-bands of the audio signal, wherein the hysteresis values include at least one of a hysteresis delay for changing from a lower selected bandwidth to a higher selected bandwidth and a hysteresis delay for changing from a higher selected bandwidth to a lower selected bandwidth.

16. The tangible media according to claim 13, wherein the instructions further perform the steps of determining the energy, determining the highest frequency sub-band, and encoding at respective periodic bases during the encoding of the audio signal on a periodic basis during the encoding of the audio signal.

17. The method according to claim 13, wherein the thresholds of two or more sets of energy thresholds are such that two or more of the following conditions exist: lower audio bandwidth encoding protocols are favoured, audio bandwidths of the encoding protocols that are selected track the varying bandwidth of the input signal, and higher audio bandwidth encoding protocols are favoured.

18. The apparatus according to claim 13, wherein a change in the bit rate value during the audio signal alters the selection of the set of thresholds from the plurality of sets.

a bit rate value;

selecting a set of energy thresholds based on the bit rate value, wherein the set of energy thresholds is one of a plurality of sets of energy thresholds, and wherein the energy thresholds of each set of energy thresholds correspond on a one-to-one basis with a set of sub-bands of the audio signal;

receiving the audio signal;

determining the energy of each sub-band of the set of sub-bands;

determining a highest frequency sub-band that has an energy exceeding the corresponding threshold;

determining a selected bandwidth of the audio signal that includes only those frequencies of the audio signal that are in the highest frequency sub-band that has an energy exceeding the corresponding threshold, as well as all lower frequencies of the audio signal that are above a high-pass cut-off frequency; and encoding the selected bandwidth.

* * * * *